US008375856B2

(12) United States Patent
Buck et al.

(10) Patent No.: US 8,375,856 B2
(45) Date of Patent: Feb. 19, 2013

(54) METHOD FOR COMPENSATING FOR AN OSCILLATION IN A PRINTING PRESS

(75) Inventors: Bernhard Buck, Heidelberg (DE); Eric Knopf, Heidelberg (DE); Matthias Nöll, Weiterstadt (DE); Stefan Schreiber, Edingen-Neckarhausen (DE); Malte Seidler, Heidelberg (DE); Detlef Strunk, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1182 days.

(21) Appl. No.: 11/728,571

(22) Filed: Mar. 26, 2007

(65) Prior Publication Data

US 2007/0221086 A1 Sep. 27, 2007

(30) Foreign Application Priority Data

Mar. 24, 2006 (DE) ..... 10 2006 013 752

(51) Int. Cl.
*B41F 13/24* (2006.01)

(52) U.S. Cl. ..... 101/484; 101/216

(58) Field of Classification Search ..... 101/216, 101/480, 484
See application file for complete search history.

(56) References Cited

U.S. PATENT DOCUMENTS

| | | | | |
|---|---|---|---|---|
| 6,156,158 | A * | 12/2000 | Kustermann | 162/198 |
| 6,401,620 | B1 | 6/2002 | Buck et al. | |
| 6,725,780 | B2 * | 4/2004 | Berti et al. | 101/484 |
| 6,796,183 | B2 * | 9/2004 | Noell | 73/593 |
| 6,805,053 | B2 * | 10/2004 | Berti et al. | 101/480 |
| 6,871,593 | B2 | 3/2005 | Knopf et al. | |
| 7,453,223 | B2 * | 11/2008 | Buck et al. | 318/432 |
| 7,478,593 | B2 * | 1/2009 | Hefftler et al. | 101/484 |
| 7,559,276 | B2 | 7/2009 | Mutschler et al. | |
| 2002/0158180 | A1 | 10/2002 | Noell | |
| 2003/0140808 | A1 * | 7/2003 | Knopf et al. | 101/483 |
| 2003/0230205 | A1 * | 12/2003 | Mutschler et al. | 101/216 |

FOREIGN PATENT DOCUMENTS

| | | | |
|---|---|---|---|
| DE | 42 34 928 | A1 | 4/1994 |
| DE | 4412945 | A1 | 10/1995 |
| DE | 199 14 627 | A1 | 10/2000 |
| DE | 100 47 725 | A1 | 4/2002 |
| DE | 101 49 525 | A1 | 5/2002 |
| DE | 102 59 494 | A1 | 7/2003 |
| DE | 103 38 976 | A1 | 4/2004 |
| DE | 103 09 670 | A1 | 9/2004 |
| DE | 103 55 122 | A1 | 6/2005 |

(Continued)

OTHER PUBLICATIONS

European Search Report dated Feb. 23, 2011.

*Primary Examiner* — Ren Yan
(74) *Attorney, Agent, or Firm* — Laurence A. Greenberg; Werner H. Stemer; Ralph E. Locher

(57) ABSTRACT

In a method for compensating an oscillation which has a frequency spectrum with a number of discrete frequency components in a printing press, at least one counter torque is introduced into the printing press in order to compensate for at least one discrete frequency component of the oscillation. A first group of one or more frequency components are compensated for by introducing one or more previously determined counter torques, and a second group of one or more frequency components is compensated for by introducing specific counter torques as a function of a measurement, carried out during the operation of the printing press, of at least one signal which contains at least the one or the plurality of frequency components.

11 Claims, 2 Drawing Sheets

FOREIGN PATENT DOCUMENTS

| | | | |
|---|---|---|---|
| EP | 1355211 | A2 | 10/2003 |
| JP | 6198855 | A | 7/1994 |
| JP | 2000313104 | A | 11/2000 |

* cited by examiner

METHOD FOR COMPENSATING FOR AN OSCILLATION IN A PRINTING PRESS

CROSS-REFERENCE TO RELATED APPLICATION

This application claims the priority, under 35 U.S.C. §119, of German application DE 10 2006 013 752.3, filed Mar. 24, 2006; the prior application is herewith incorporated by reference in its entirety.

BACKGROUND OF THE INVENTION

Field of the Invention

The invention relates to a method for compensating for an oscillation which has a frequency spectrum with a number of discrete frequency components in a printing press, at least one opposing or counter moment (torque) is introduced into the printing press in order to compensate for at least one discrete frequency component of the oscillation.

In printing presses, disruptive oscillations can occur which have a negative influence on the printing quality. In particular for sheet-fed printing presses having a long printing unit group, which is to say a large number of printing units disposed in series, typically eight, ten or twelve printing units, particularly high precision is necessary in order for example to avoid position errors during the transfer of printing material sheets from a first element carrying a sheet to a second element carrying a sheet (transfer error, register error). Even small oscillation amplitudes can already have an unacceptable effect in such sensitive mechanical systems.

In principle, by a few constructional measures, an influence can already be exerted on the dynamic characteristics of the printing press, in particular a sheet-fed printing press, in order that resonances lie far away from the exciting frequencies of the disruptive oscillations. Attempts can also be made, by constructional measures, to reduce the size of the possible interference sources or to eliminate them or to reduce the size of the coupling constants to resonances. For instance, resonant frequency shifts can be achieved by fabrication changes, reductions in excitation by specific selection of actual components or reductions in the size of the coupling by skillful drive offsetting. Finally, it is also possible to attempt to couple individual interference sources in suitable phase, so that the superimposition of the individual excitations leading to an oscillation is as minimal as possible. However, it must be recorded that, in general, the freedom opened up by mechanical measures is too small for disruptions to be reduced to below an acceptable threshold.

Published, non-prosecuted German patent application DE 199 14 627 A1, corresponding to U.S. Pat. No. 6,401,620 B1, discloses a method and an apparatus for compensating for an oscillation in a printing press by introducing opposing or counter moments. At least one eigenform of the printing press is determined and, at a location in the drive train of the printing press at which the eigenform is not zero, the respective counter moment for the compensation of the entire oscillation is determined and stored. During the operation of the printing press, the predetermined counter moment is applied at the aforesaid location, so that the oscillation is reduced to the maximum extent. In a preferred embodiment, the counter moment is produced by a cam mechanism. The counter moment can be produced as a function of the machine rotational speed or machine frequency.

Published, non-prosecuted German patent application DE 101 49 525 A1, corresponding to U.S. patent publication No. 2002/0158180 A1, discloses a further method and a further apparatus for compensating for an oscillation in a printing press by the introduction of counter moments. At least one, preferably all, of the frequency components of the frequency spectrum of the oscillation are measured directly or indirectly, and each of these frequency components, irrespective of the other frequency components, has superimposed on it an appropriate counter moment, in particular a substantially harmonic moment, of the same frequency with a specific amplitude and phase by an actuator acting directly or indirectly on the machine shaft, in such a way that the amplitude of the oscillation at this frequency is reduced. In a preferred embodiment, this technical teaching is used to compensate for oscillations of non-integer order in relation to the machine frequency.

SUMMARY OF THE INVENTION

It is accordingly an object of the invention to provide a method for compensating for an oscillation in a printing press, which overcomes the herein-mentioned disadvantages of the heretofore-known methods and devices of this general type, in-which the oscillation can be countered with little effort by using a plurality of actuators.

With the foregoing and other objects in view there is provided, in accordance with the invention, a method for compensating for an oscillation having a frequency spectrum with a number of discrete frequency components in a printing press. The method includes introducing at least one previously determined counter torque into the printing press for compensating for a first group of components containing at least one of the discrete frequency components and introducing further specific counter torques as a function of a measurement, carried out during an operation of the printing press, of at least one signal containing at least one of the discrete frequency components for compensating a second group of components containing the at least one discrete frequency component.

In the method according to the invention for compensating for an oscillation, in particular a rotational oscillation, which has a frequency spectrum with a number of discrete frequency components in a printing press, in particular a sheet-fed printing press, at least one counter moment is introduced into the printing press, in particular the sheet-fed printing press, in order to compensate for at least one discrete frequency component of the oscillation. A first group of one or more frequency components is compensated for by introducing one or more previously determined counter moments, and a second group of one or more frequency components is compensated for, in particular preferably completely or accurately, by introducing specific counter moments as a function of a measurement, carried out during the operation of the printing press, of at least one signal, that is to say one signal or a plurality of signals, which contains or contain at least the one or the plurality of frequency components.

The invention is based on the idea of compensating for an oscillation, in particular a rotational oscillation, in a printing press by using a method in which the individual frequency components of the oscillation are subdivided into a plurality of, preferably two, groups or classes. The frequency spectrum of the printing press without a compensation method acting is considered and a classification or distribution of the frequency components determined is carried out. For each of these classes, a compensation method which is adapted optimally for the purpose of the most complete compensation possible is selected, so that the overall oscillation amplitude which occurs is minimized. The oscillation is advantageously countered with the least possible effort. Ideally, a counter moment has an amplitude of which the magnitude is matched and has an opposing phase in relation to the oscillation to be compensated such that the superimposed amplitude is as low as possible, preferably vanishes (becomes zero).

Here, the oscillation can be an oscillation of the entire printing press or machine component, for example a shaft of a cylinder. The shaft can be a directly or indirectly driven shaft. The oscillation can relate, for example, to the position, the speed or the acceleration. The oscillation can, for example, also be an oscillation of what is known as a virtual machine shaft, that is to say an oscillation of a relative position, a relative speed or a relative acceleration between two machine components.

The course of the predetermined counter moments for the first group can be stored in hardware or in software in a control unit of the printing press and be available for the compensation. The measured signal can be the signal from at least one machine rotary encoder, for example an encoder for the machine rotational speed.

The one or the plurality of previously determined counter moments for the compensation for the first group of one or more frequency components can, according to the technical teaching of the published, non-prosecuted German patent application DE 199 14 627 A1, corresponding to U.S. Pat. No. 6,401,620 B1, be used and transmitted according to the invention only in relation to the first group, which is to say only one part or one subset of the frequency content of the oscillation, but not for example for the entire oscillation. The entire disclosure content of published, non-prosecuted German patent application DE 199 14 627 A1 and of U.S. Pat. No. 6,401,620 B1 are incorporated by reference herein.

The one or the plurality of counter moments determined as a function of a measurement of a signal carried out during the operation of the printing press, which signal contains at least the one or the plurality of frequency components, for the compensation for the second group or one or more frequency components can, according to the technical teaching of published, non-prosecuted German patent application DE 101 49 525 A1, corresponding to U.S. patent publication 2002/0158180 A1, be used and transmitted according to the invention only in relation to the second group, which is to say only another part or another subset of the frequency content of the oscillation, but not for example for the entire oscillation. The entire disclosure content of published, non-prosecuted German patent application DE 101 49 525 A1 and of U.S. patent disclosure No. 2002/0158180 A1 are incorporated by reference herein.

In a preferred embodiment of the method according to the invention, the second group contains only one or a plurality of frequency components which are not contained in the first group. Furthermore or as an alternative to this, in a preferred embodiment of the method according to the invention, the frequency components of the first group and of the second group can together yield a substantial part or exactly the frequency spectrum. The substantial part is to be understood to mean the proportion of the frequency spectrum which cannot be disregarded in order to counter the oscillation until it is below an acceptance threshold.

In an advantageous expression of the method according to the invention for compensating for an oscillation, the frequency component or components of the first group can be integer multiples (in general including 1, preferably greater than 1) of the machine frequency, and the frequency component or components of the second group can be non-integer multiples of the machine frequency. The machine frequency or drive frequency, in particular main drive frequency, relates in particular to the rotational speed, cycle rate or copy rate.

In the method according to the invention for compensating for an oscillation, the frequency component or components of the first group are preferably load-relevant frequencies, and the frequency component or components of the second group are preferably register-relevant frequencies. Frequencies are load-relevant when they exhibit an integer order in relation to the machine frequency, require a high moment for compensation and are deterministic in as much as the amplitude and phase of the frequency component can be determined before the operation of the printing press. Frequencies are register-relevant when they exhibit a non-integer order in relation to the machine frequency, require a small moment, typically only a few newton meters, for compensation and cannot be determined in advance or are copy-specific, in as much as the amplitude and phase of the frequency component of the oscillation must be determined and compensated for individually during the operation of the printing press.

When breaking down the frequency spectrum of the oscillation into frequency components and classifying the frequency components in groups, it may be sufficient to take into account only those, normally low-frequency, components, which are able to excite the low eigenmodes, in particular the first and the second eigenfrequency of the printing press, that is to say lie sufficiently close to the resonances of the printing press. The higher-frequency components are normally small relative to the others and as a rule do not need to be taken into account. In other words, the oscillation can be represented substantially, which is to say within an error interval that is acceptable for the application of the oscillation compensation, by the low-frequency components.

The introduction of the (predetermined) counter moment or moments of the first group of the frequency component or components and/or of the counter moment or moments of the second group of the frequency component or components, determined on the basis of the signal or signals, can be carried out in the method according to the invention at locations selected in accordance with the amplitude variation of one of the eigenforms of the printing press.

In the method according to the invention, the measurement of the signal preferably contains at least one orthogonal correlation in order to determine amplitude and phase of a frequency component of the second group. Furthermore or as an alternative to this, in the method according to the invention the one or the plurality of previously determined counter moments can be produced and introduced by one or more mechanical devices. The one or more mechanical devices can be cam mechanisms, in particular cam disks. The cam mechanisms, in particular cam disks, can be configured in such a way that they act periodically with-one or more integer multiples (in general including 1, preferably greater than 1) of the machine frequency. As an alternative to one or more mechanical devices, one or more electric cams, in particular periodic drive profiles for an electric drive, can be used to drive an actuator, so that one or more previously determined counter moments are produced and introduced by one or more electric cams. An electric cam used in accordance with the invention can in particular be configured as a function of the machine frequency, that is to say machine speed-dependent.

Furthermore or as an alternative to this, it is preferred if the one or the plurality of counter moments of the second group, determined as a function of the measurement, are introduced only if the frequency component corresponding to the counter moment or moments is in resonance with an eigenfrequency of the printing press. In other words, the discrete oscillation compensation is preferably operated or switched on only when it is actually necessary because an effect on the printing press is to be expected.

Taking account of the excitation possibilities of the frequency components of the oscillation to the eigenfrequencies or eigenforms (eigenmodes) of the printing press can also be designated a modal approach or modal compensation. In particular, according to the invention modal compensation of the register-relevant (non-integer) and/or load-relevant (integer) frequency components can be carried out.

Furthermore or as an alternative to this, it is preferred if the one or the plurality of previously determined counter moments of the first group is introduced in the vicinity of the start and/or of the end, substantially at the start and/or at the end, of the series of printing units of the printing press, in particular via devices with stored moment profiles, and for the one or the plurality of counter moments of the second group, determined as a function of the measurement, to be introduced in the vicinity of the middle or substantially in the middle of the series of printing units of the printing press, in particular by the main motor of the printing press. For the first group of frequency components, in particular load-relevant, which is to say frequency components making high compensation moments necessary, the lever arms in the vicinity of the start and/or of the end of the printing unit group are particularly beneficial to the compensation for the eigenform or eigenforms coupling to the oscillation. When the main motor of the printing press is used, in particular for the second group of frequency components, preferably the register-relevant ones, in practical terms an actuator without additional hardware or a hardware change is available with this drive. However, it is clear that, as an alternative to this, an additional actuator can also be used.

Furthermore or as an alternative to this, it is advantageous that, in a preferred expression of the method according to the invention, the frequency component or components of the second group are determined from the difference between the signals from at least two encoders or sensors which are arranged at mutually different locations of the printing press.

In an advantageous development of the method according to the invention, both at least one of the predetermined counter moments and at least one of the counter moments determined on the basis of the signal or signals are introduced together by one actuator. In other words, the counter moments to be introduced into the printing press at one location for the compensation for both classes can be applied by an identical actuator of the printing press. The counter moments can be impressed on a drive moment of the actuator. In particular, this actuator can be located in the vicinity of the start or the end of the series of printing units of the printing press.

Also connected to the idea according to the invention is a printing press, in particular a sheet-fed printing press. The method according to the invention can be used in particular in a lithographic printing press or offset printing press. The printing press can be a multicolor printing press, in particular have a plurality of printing units in series, typically 4, 6 or 8 printing units. The printing press can preferably process paper or board as printing materials. A printing press according to the invention has a device suitable to or configured to carry out the method according to the invention in order to compensate for an oscillation which has a frequency spectrum with a number of discrete frequency components, and at least one actuator for introducing at least one counter moment into the printing press in order to compensate for at least one discrete frequency component of the oscillation. The printing press can have at least one actuator in each case for introducing one or more predetermined counter moments for the first group of frequency components at the ends of the series of printing units, and at least one actuator which, in particular can be the main drive of the printing press, substantially in the middle of the printing unit group of the printing press, with which drive one or more counter moments for the second group of frequency components can be introduced. The printing press can have at least one, preferably two, encoders or sensors, which are disposed in the printing press in such a way that they are not located at locations at which the eigenform coupling to the oscillation is zero. The encoders can in particular be rotary encoders.

Other features which are considered as characteristic for the invention are set forth in the appended claims.

Although the invention is illustrated and described herein as embodied in a method for compensating for an oscillation in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
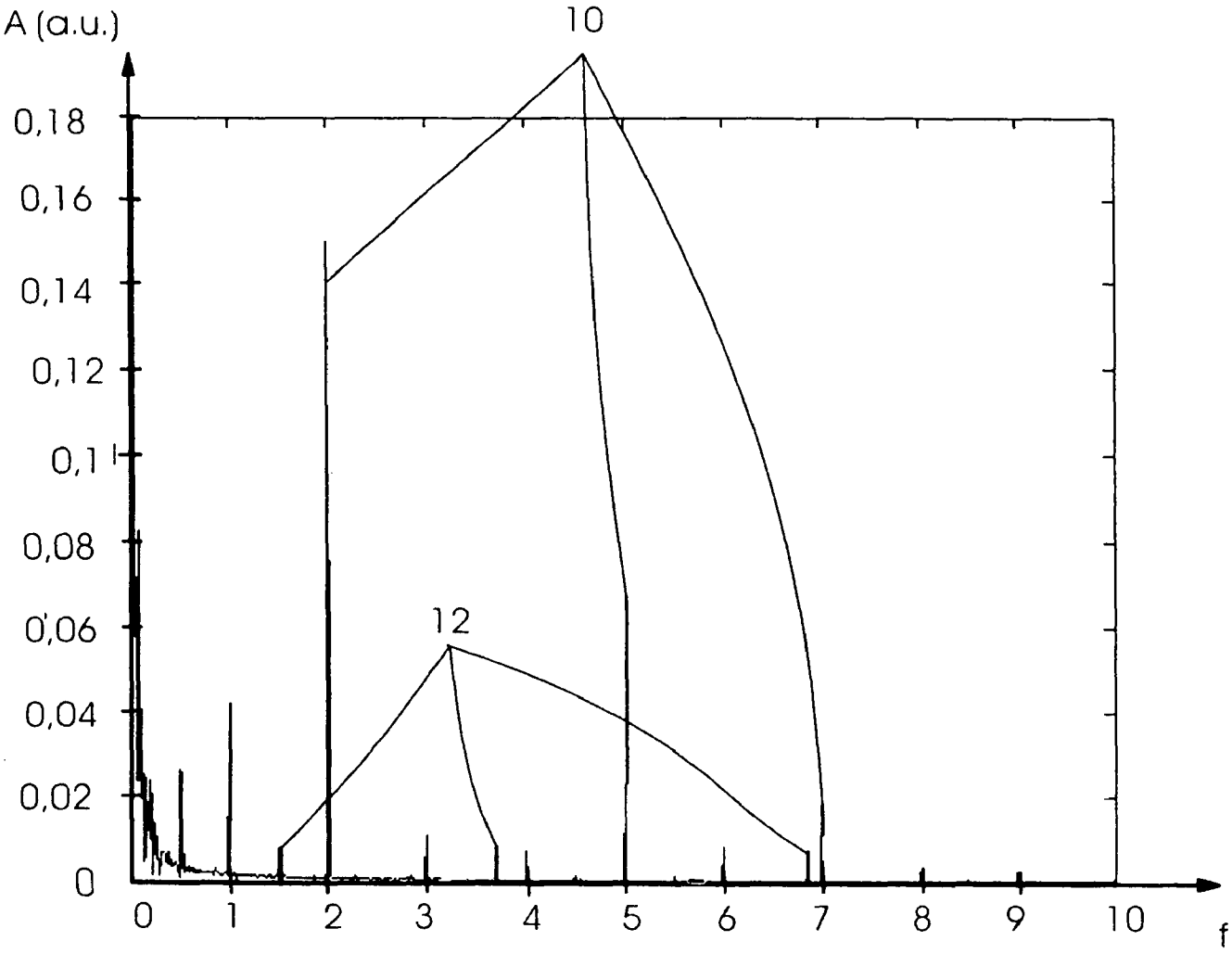
FIG. 1 is a graph showing a qualitative illustration of an exemplary representative frequency spectrum of an oscillation of a sheet-fed printing press according to the invention.

Referring now to the figures of the drawing in detail and first, particularly, to FIG. 1 thereof, there is shown a schematic qualitative illustration of an exemplary representative frequency spectrum of an oscillation of a sheet-fed printing press having a large number of printing units. The magnitude of an amplitude A in appropriate units (a.u.) is plotted as a function of a relative frequency f, based on a machine frequency $\omega_M$. The frequency spectrum exhibits a plurality of discrete frequency lines of different amplitude. Frequency components exist which represent integer multiples (including 1) of the machine frequency $\omega_M$. Furthermore, frequency components exist which are not integer multiples of the machine frequency $\omega_M$. The amplitudes of the non-integer frequency components are considerably smaller than those of the integer frequency components. The sum of the frequency components of the frequency spectrum converges as the frequency increases toward the oscillation, which is to say that the oscillation can be represented with sufficient accuracy by the low-frequency components. In the example shown in practical terms in FIG. 1, there are only frequency components up to seven times the machine frequency $\omega_M$. According to the invention, for the compensation method, a group wise classification of the frequency spectrum in a preferred embodiment is carried out in the now described way. Classified in a first group 10 are the integer frequency components and a second group 12 is formed of the non-integer frequency components. In order to counter the integer and relatively high frequency components of the first group 10, according to the invention predetermined counter moments (torques) are used. In order to compensate for the non-integer and relatively weak frequency components of the second group 12, according to the invention counter moments (torques) determined from measurements are used. Throughout this application the terms torque and moment are used interchangeably as a torque is also called a moment.

The absolute frequency of the frequency components varies with the machine frequency $\omega_M$. The amplitude of a frequency component can also vary as a function of machine frequency $\omega_M$. In reality, an amplitude variation of the integer moments as a function of the frequency for integer frequency components is frequently either not present or negligibly small within the context of the precision required. Particular significance is gained by a frequency component in particular when it comes into resonance with an eigenfrequency of the printing press, which is to say when the frequencies of the frequency component and eigenoscillation resemble each other or coincide to a sufficient extent since then, in particular, excitation of the resonance of the printing press as far as oscillation can take place. In practice, it has transpired that typically only one or a few oscillation exciters, which is to say only one frequency component or a few frequency components is or are in resonance with an eigenfrequency. The oscillatory behavior of the printing press in such a situation is determined only by a single frequency, whose oscillation has to be countered.

Figure 2:
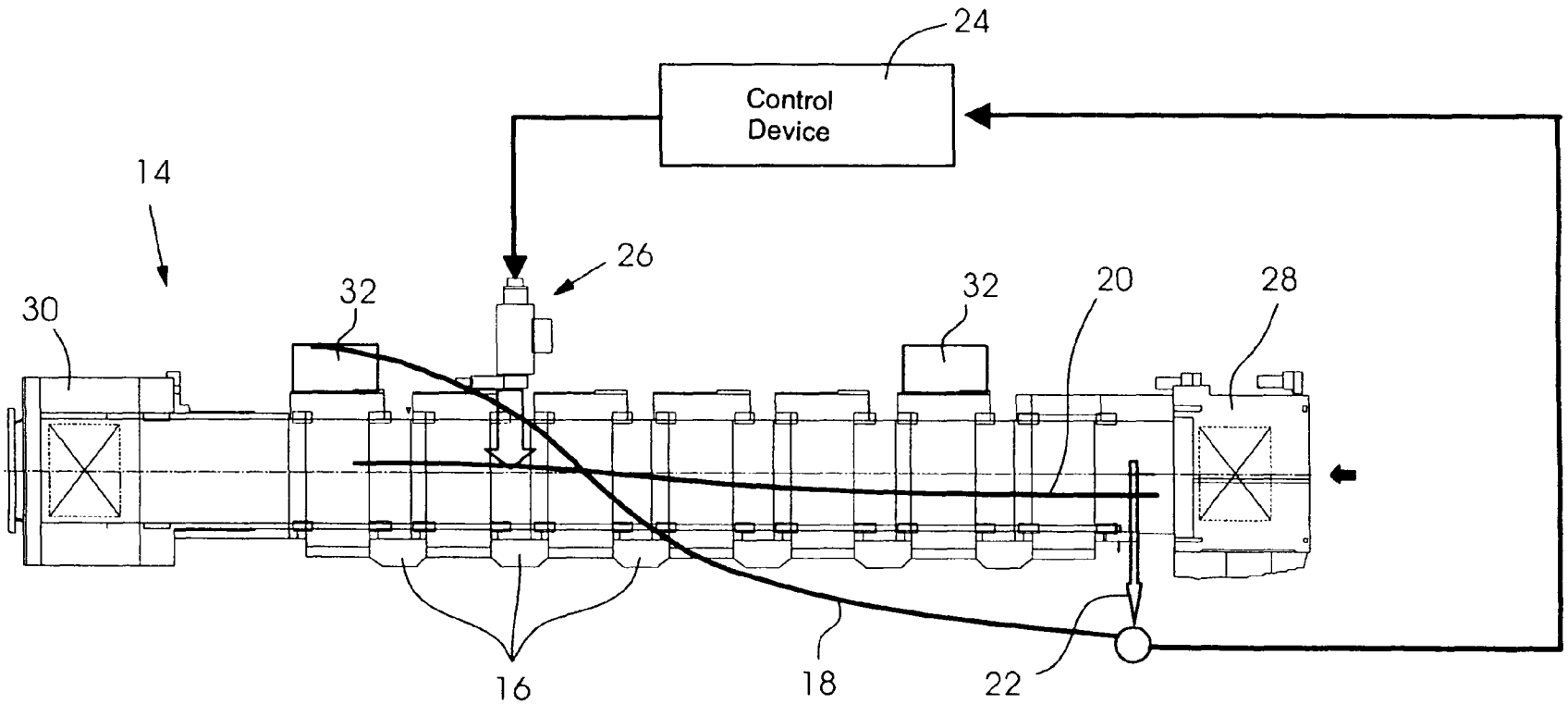
FIG. 2 is a diagrammatic, illustration of an embodiment of a printing press according to the invention.

FIG. 2 is a schematic illustration of an embodiment of a printing press 14 according to the invention, a sheet-fed printing press here, having six printing units 16, a feeder 28 and a deliverer 30. The printing press 14 can be excited to an oscillation in an eigenform 18, in particular in consequence of the action, explained in relation to FIG. 1, of resonant frequency components of interferences (oscillation exciters).

The aim is compensation of the oscillation of an eigenform 18, so that a reduced or compensated oscillation 20 of the eigenform results. To this end, according to the invention the printing press 14 has mechanical devices 32, two cam mechanisms here, as explained in detail in published, non-prosecuted German patent application DE 199 14 627 A1, corresponding to U.S. Pat. No. 6,401,620 B1, at both ends of a series of the printing units 16 in order to produce predetermined counter moments. These positions are particularly advantageous in relation to the amplitude variation of the eigenform 18 shown. The frequencies of the counter moments are proportional to the machine frequency, in particular multiples (including 1) of the machine frequency. The amplitudes of the counter moments can be constant: by using the predetermined counter moments, oscillations produced by oscillation exciters with a constant force action or moment action are compensated for, so that the necessary amplitudes for compensation do not change with the machine frequency.

Furthermore, by use of an encoder 22, a signal representative of the oscillation is converted and supplied to a control device 24. With the aid of the control device 24, the necessary counter moment for compensation can be calculated. The counter moment is impressed on the drive moment of a main drive 26, so that compensation for the oscillation of the eigenform 18 is effected. Oscillation and the opposing oscillation induced by the counter moment are preferably intended to annul each other, at least the intention is for the resultant overall oscillation to be below an acceptance threshold. The encoder 22 will be able to measure a signal in particular when an oscillation excitation or a frequency of an oscillation exciter comes into resonance with the frequency of the eigenform 18. The position of the encoder 22 is advantageously chosen in such a way that the oscillation to be measured of the eigenform at the measuring location exhibits a considerable amplitude range and is not zero. For differential measurements between two or more encoder signals, care must be taken that there is advantageously a considerable differential range of the individual signal amplitudes of the two or more encoders. In a development of the printing press according to the invention which is not illustrated graphically, it is also possible for a plurality of encoders for a plurality of eigenforms in each case to be arranged in an optimized manner and evaluated.

We claim:

1. A method for compensating for an oscillation having a frequency spectrum with a number of discrete frequency components in a printing press, which comprises the steps of:

analyzing the frequency spectrum and determining frequency components of the oscillation;

classifying individual frequency components into a first group including integer multiples of a machine frequency $\omega_M$ and into a second group including non-integer multiples of the machine frequency $\omega_M$;

determining a first counter torque for compensating only frequency components of the first group and introducing the first counter torque into the printing press;

operating the printing press;

while the printing press is operating and the first counter torque is applied to the printing press, measuring amplitudes of the second group of frequency components; and determining second counter torques for compensating frequency components of the second group from said measurements and additionally introducing the second counter torques into the printing press.

2. The method for compensating for the oscillation according to claim 1, wherein the discrete frequency components of the first group and of the second group together yield a substantial part of the frequency spectrum or exactly the frequency spectrum.

3. The method for compensating for the oscillation according to claim 1, wherein:

at least one discrete frequency component of the first group is a load-relevant frequency; and at least one discrete frequency component of the second group is a register-relevant frequency.

4. The method for compensating for the oscillation according claim 1, which further comprises carrying out the introducing of the first counter torque and the second counter torques at locations selected in accordance with an amplitude variation of one of eigenforms of the printing press.

5. The method for compensating for the oscillation according to claim 1, wherein the measuring step includes at least one orthogonal correlation for determining amplitude and phase of a frequency component of the second group.

6. The method for compensating for the oscillation according to claim 1, which further comprises producing and introducing the first counter torque by means of one of at least one mechanical device and at least one electric cam.

7. The method for compensating for the oscillation according to claim 1, which further comprises introducing the second counter torques only if a frequency component corresponding to the second counter torques is in resonance with an eigenfrequency of the printing press.

8. The method for compensating for the oscillation according to claim 1, which further comprises:

introducing first counter torque substantially at least one of a start and at an end of a series of printing units of the printing press; and introducing the second counter torques in a vicinity of a middle of the series of the printing units of the printing press.

9. The method for compensating for the oscillation according to claim 1, which further comprises determining at least one discrete frequency component of the second group by determining from a difference between signals from at least two encoders which are disposed at mutually different locations of the printing press.

10. The method for compensating for the oscillation according to claim 1, which further comprises introducing together the first counter torque and at least one of the second counter torques by one actuator.

11. The method for compensating for the oscillation according to claim 1, wherein the second group contains the discrete frequency components which are not contained in the first group.

* * * * *